United States Patent [19]

Krautkremer

[11] 4,412,500

[45] Nov. 1, 1983

[54] DRIVE MECHANISM FOR SHIPS OR THE LIKE COMPRISING A MAIN PROPELLER AND AN AUXILIARY MECHANISM

[75] Inventor: Franz Krautkremer, Spay, Fed. Rep. of Germany

[73] Assignee: Schottel-Werft, Josef Becker GmbH & Co. KG, Spay, Fed. Rep. of Germany

[21] Appl. No.: 424,794

[22] Filed: Sep. 27, 1982

Related U.S. Application Data

[63] Continuation of Ser. No. 299,284, Sep. 4, 1981, abandoned, which is a continuation of Ser. No. 82,203, Oct. 5, 1979, abandoned.

[30] Foreign Application Priority Data

Jan. 4, 1979 [DE] Fed. Rep. of Germany ..... 2900254

[51] Int. Cl.[3] ..... B63H 25/46

[52] U.S. Cl. ..... 114/151; 60/390; 60/395; 60/448; 440/5

[58] Field of Search ..... 114/151; 440/3-6; 60/448, 395, 390; 290/4 C, 17

[56] References Cited

U.S. PATENT DOCUMENTS

| | | | |
|---|---|---|---|
| 2,871,660 | 2/1959 | McDonald et al. | 60/390 |
| 3,628,042 | 12/1971 | Jacobus | 60/395 |
| 3,826,218 | 7/1974 | Hiersig et al. | 440/4 |
| 3,842,287 | 10/1974 | Nakamura | 290/17 |
| 3,874,316 | 4/1975 | Lorenz | 114/151 |
| 3,993,912 | 11/1976 | Ekstrom et al. | 290/17 |
| 4,056,073 | 11/1977 | Dashew et al. | 114/151 |
| 4,191,270 | 3/1980 | Monteith | 60/448 |

*Primary Examiner*—Sherman D. Basinger
*Attorney, Agent, or Firm*—Flynn, Thiel, Boutell & Tanis

[57] ABSTRACT

A drive mechanism for ships or the like having at least one main propeller or the like drivable by at least one main motor and further having at least one drivable auxiliary mechanism, for example a maneuvering propeller. An energy producer is drivable by the main motor. A further motor is driven by the energy producer and arranged for driving the drivable auxiliary mechanism. An adjusting mechanism is provided for adjusting energy emitted by the energy producer or absorbed by the further motor. A regulator adjusts the adjusting mechanism to a preselected energy output. The main motor and the auxiliary mechanism are sized such that in the higher part of the speed range of the main motor, the sum of the energy required to drive the propulsion means at that speed and simultaneously drive the auxiliary mechanism at that speed exceed the output available from the main motor.

2 Claims, 4 Drawing Figures

L [%]
125
100
75
50
25
0

$L_P + L_Q$
$L_M$
$L_Q$
$L_P$
0
25
50
75
100
$n_L$
$n_S$
$n_M$ [%]

DRIVE MECHANISM FOR SHIPS OR THE LIKE COMPRISING A MAIN PROPELLER AND AN AUXILIARY MECHANISM

This is a continuation of application Ser. No. 299,284, filed Sept. 4, 1981, now abandoned, which is a continuation of application Ser. No. 082 203, filed Oct. 5, 1979, now abandoned.

FIELD OF THE INVENTION

The invention relates to a drive mechanism, for ships or the like, having at least one main propeller or the like driven by at least one motor and having at least one drivable auxiliary mechanism, for example a maneuvering propeller.

BACKGROUND OF THE INVENTION

The present invention has, for such a drive mechanism, the purpose of assuring at various speeds of the main motor, a preselected energy output, for example a preselected speed, of the auxiliary mechanism.

If hereinafter reference is made to a main motor, an auxiliary mechanism and also otherwise singular terms are used, it will be understood that the invention still relates to a plurality of mechanisms. The term motor, as used in describing the present invention, is intended to mean any type of drive mechanisms, including for example steam turbines. The term auxiliary mechanisms, as used in describing the present invention is intended to include fire-extinguishing mechanisms or other auxiliary machines, lateral thrust rudders, rudder propellers or other maneuvering aids and all conceivable mechanisms, which are driven by the main motor and are supposed to run with a different speed than the main mechanism driven by the main motor, for example the main propeller. The term propeller, or propulsion means, relates to all mechanisms for thrust production, thus for example also to cycloidal propellers, jet drives and other propulsion means.

The basic purpose of the invention is attained by providing a drive mechanism wherein an energy producer is drivable by the main motor, a further motor is driven by the energy producer and is arranged for driving the drivable auxiliary mechanism, and adjusting mechanism for the energy emitted by the energy producer, or absorbed by the further motor is provided and a regulator is arranged for adjusting the adjusting mechanism to a preselected energy output.

Further characteristics of the invention, as hereafter described, provide particularly simple, strong and economical drive mechanism.

Further advantages and characteristics of the invention can be taken from the following description.

BRIEF DESCRIPTION OF THE DRAWINGS

The invention is discussed in connection with an exemplary embodiment which is illustrated in FIG. 1 to 4, in which.

DETAILED DESCRIPTION

Figure 1:
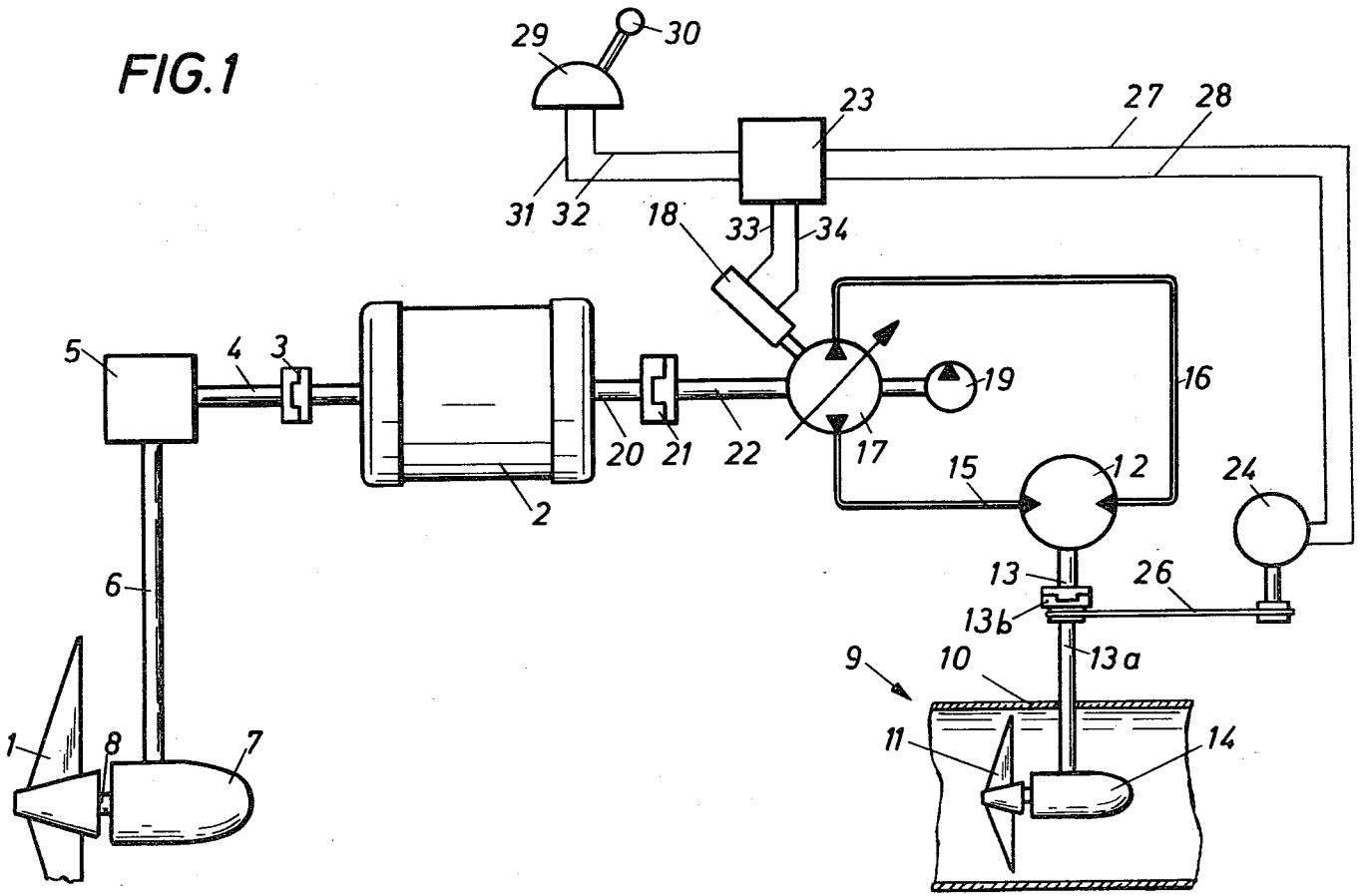
FIG. 1 schematically illustrates a drive mechanism according to the invention in connection with the example of a lateral jet rudder.

FIG. 1 illustrates a drive mechanism for a ship, which ship is not illustrated. The ship is driven by at least one main propeller 1, which may be a so-called steerable propeller. The main propeller is driven by at least one main motor 2 through a coupling 3 (which may be a shiftable coupling, or clutch), a shaft 4, an angular drive 5 (for example a bevel gear unit of which only the housing is indicated), a transmission shaft 6, a second angular drive 7 (of which only the housing is illustrated), and a propeller shaft 8.

The ship can, for the purpose of maneuvering, be additionally driven by at least one maneuvering propeller, for example a lateral jet rudder 9, which consists substantially of a cross tunnel 10 which leads from the one side of the ship to the other and a propeller 11 which is arranged therein.

The propeller 11 is driven by a hydraulic motor 12 through a drive shaft 13, 13*a* and a miter gear, for example a bevel gear unit 14, which is arranged in the cross tunnel 10, of which gear unit 14 only the housing is illustrated. The drive shaft parts 13, 13*a* are connected by a coupling 13*b*. The hydraulic motor 12 receives its energy, here for example pressure fluid, through pressure pipelines 15, 16 from a pump 17, the output or pressure of which can be adjusted in a conventional manner. In the example shown, the pump 17 has several cylinders, the output volumes of which can be adjusted. The adjusting mechanism for the cylinders is identified by reference numeral 18. Such adjustable pumps are known and common in trade, so that a schematic illustration thereof is sufficient. Reference numeral 19 identifies a schematically illustrated, conventional fill pump, with which possibly leakage losses are replaced. The pump 17 is driven from the main motor 2 through a drive shaft 20, a coupling 21 (which may be a shiftable coupling, or clutch) and through a second drive shaft 22. The remaining elements of such a hydraulic system, like filters, valves etc. are known and need therefore not be described.

The rotational speed of the propeller 11 of the lateral jet rudder 9 can be preselected as desired at a constant speed or at any desired chosen speed of the main motor 2. For this purpose an actual value-desired value comparison mechanism 23 is provided, which will be described hereinafter.

The actual value is taken off by a tachogenerator 24 by means of a belt drive 26 or the like at the drive shaft 13, 13*a* of the propeller 11 and is fed through electric lines 27, 28 to the actual value-desired value comparison mechanism 23. The desired value is adjusted on an advancing mechanism 29 by means of a hand lever 30, for example by adjusting a conventional resistor or potentiometer (not shown) and is communicated to the actual value-desired value comparison mechanism 23 through electric lines 31, 32. The result of the actual value-desired value comparison is transmitted through electric lines 33 and 34 to the adjusting mechanism 18 of the pump.

Figure 2:
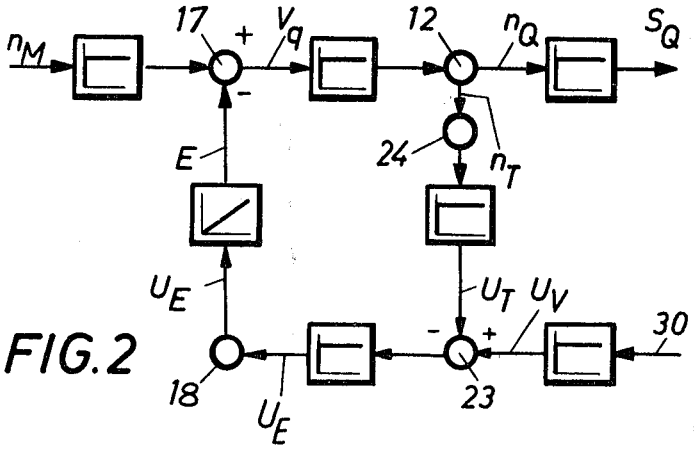
FIG. 2 illustrates as a block circuit diagram an actual value-desired comparison regulator.

Actual value-desired value comparison mechanisms, particularly of the electrical type, are known, for example the well-known Wheatstone bridge based on resistors, capacitors and/or inductors may be mentioned, and electronic comparators are also known. Furthermore, hydraulic and pneumatic comparison mechanisms, which are based on pressure differences, are known. Thus the comparison mechanism 23 may be of any conventional type and does not need to be described in detail. The block circuit diagram of FIG. 2 schematically illustrates how the above-mentioned elements are connected in a control circuit.

The arrow $n_M$ indicates an input representing the rotational speed of the main motor 2 (input signal), which drives the pump 17 through the shafts 20,22. The pump 17 operates, that is it emits an output dependent on the position of the adjusting mechanism 18, which thus determines the output $V_q$ of the pump 17. Said pump output determines the rotational speed $n_Q$ of the propeller 11 in the cross tunnel and thus also the lateral thrust $S_Q$, here illustrated as the circuit output signal. The tachogenerator 24 reads the speed $n_T$ and transmits it in the form of a voltage $U_T$ to the actual value-desired value comparison mechanism 23 as the actual value. A voltage $U_V$, corresponding with the desired value, is selected by the hand lever 30. The actual value-desired value comparison device 23 emits, as a result of its comparison, the voltage $U_E=(U_T-U_V)$ as a feedback signal to the drive of the adjusting mechanism 18, which converts said signal into a pump adjusting displacement E, with which the control loop is closed. Thus, if the actual speed voltage $U_T$ is for example too high, the comparison device 23 causes the output of the pump 17 to be reduced in a manner to return the actual speed voltage $U_T$ to correspondence to the desired speed voltage $U_V$. In consideration of electronic devices it would also be possible to use above in place of the voltages also potentials.

Figure 3:
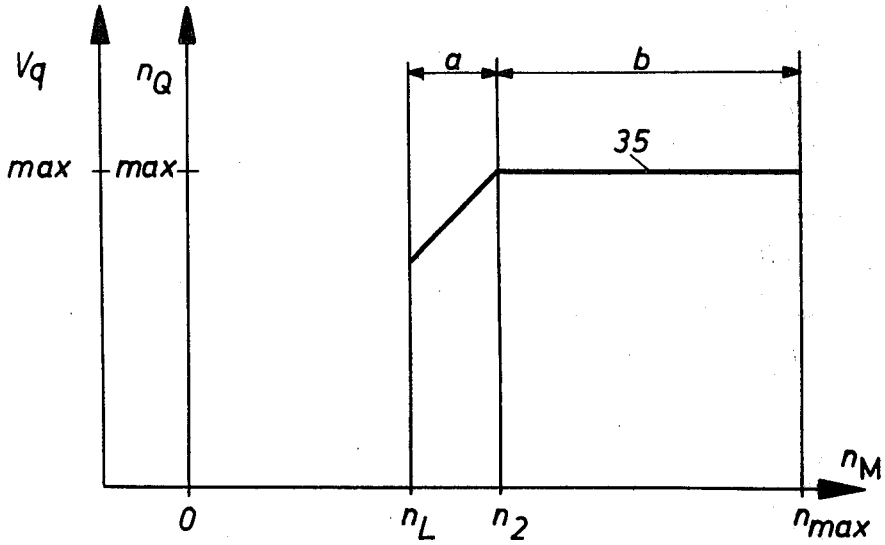
FIG. 3 graphically illustrates the output of the pump and the rotational speed of the maneuvering propeller of FIG. 1 when the hand control lever is fully deflected.

The diagram of FIG. 3 illustrates the characteristic 35 of the output $V_q$ of the pump 17 and simultaneously the speed $n_Q$ of the propeller 11 in dependence on the speed $n_M$ of the main motor 2 at a maximum stroke volume of the pump 17. This stroke volume results at a maximum deflection of the hand lever 30. The output $V_q$ and thus the speed $n_Q$ of the propeller 11 can then be chosen in the working range which lies below the characteristic 35. In a lower speed range "a" between the idling speed $n_L$ and a speed $n_2$ of the motor, the pump output is limited by the pump itself. In an upper speed range "b" between speeds $n_2$ and $n_{max}$ the pump output is limited by the control circuit (FIG. 2). FIG. 3 in particular shows the stroke volume of the pump 17 being dimensioned such that with the lever 30 at maximum deflection, in the range from the main motor idling speed $n_L$ up to a main motor speed $n_2$ of approximately 50 percent of the main motor maximum speed, the output $V_q$ of the pump is determined by its stroke volume and above the main motor speed $n_2$ (range b) the output $V_q$ of the pump is seen to be limited by the FIG. 2 control circuit, as above stated.

Figure 4:
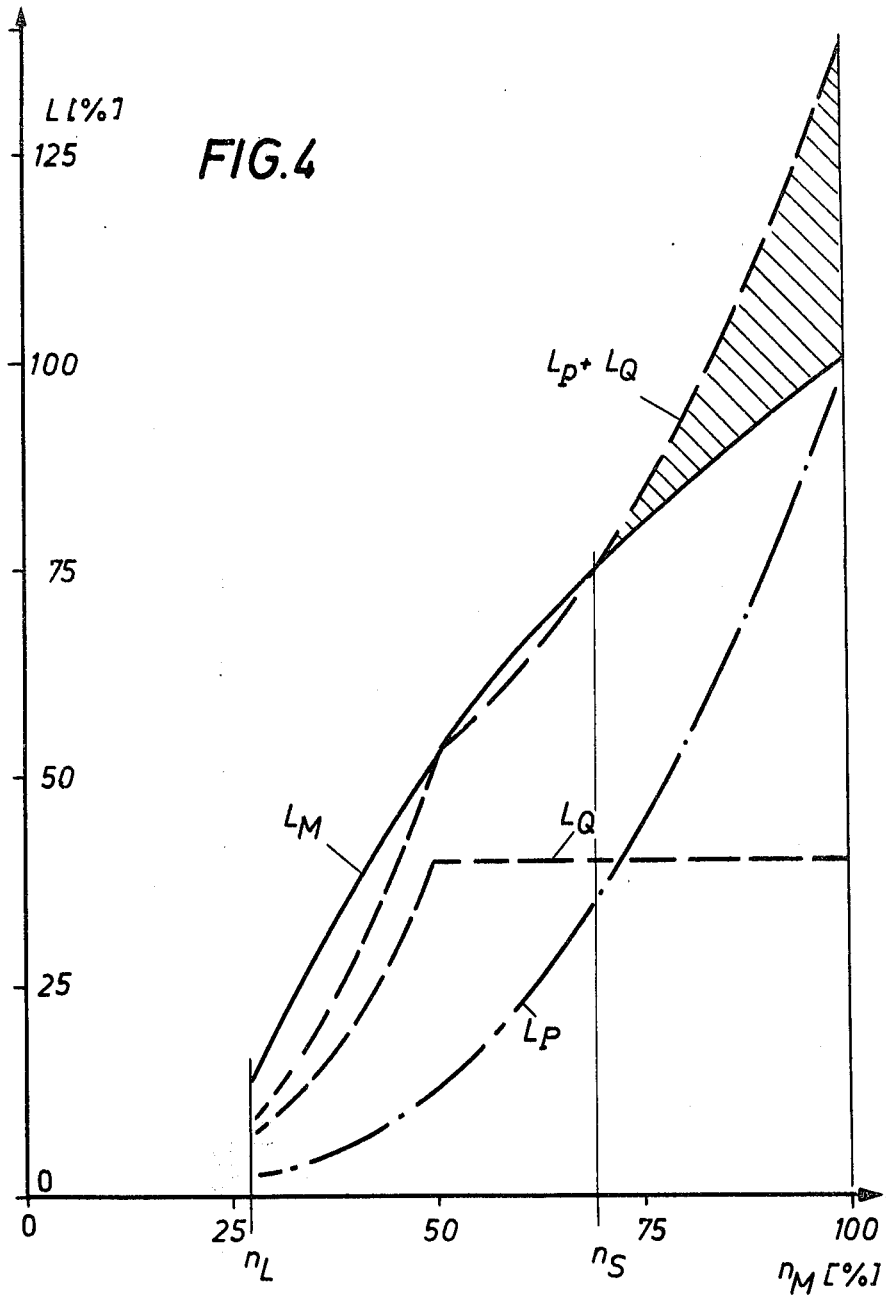
FIG. 4 illustrates the speed output characteristic of the main motor, the main propeller and an auxiliary mechanism, here for example a maneuvering propeller.

The diagram of FIG. 4 illustrates the outputs $L_M$ of the main motor 2, $L_p$ of the main propeller 1, $L_Q$ of the maneuvering propeller 11 and of the sum $L_P+L_Q$ of the two propellers 1 and 11. In the example according to FIG. 4 it is assumed that the maximum output taken up by the auxiliary drive, namely in this case by the propeller 11 of the lateral thrust system, amounts to 40% of the maximum output taken up by the main propeller. A particularly advantageous characteristic of the invention is that the sum of the outputs $L_p+L_Q$ exceeds the available output $L_M$ of the main motor 2 in the upper speed range of the main motor (as represented by the shaded area in FIG. 4). As more particularly shown in FIG. 4, the main motor 2 and maneuvering propeller 11 are sized such that in the upper speed range of the main motor, starting with the main motor speed $n_S$ which is approximately 75 percent of the maximum main motor speed, said sum $L_P+L_Q$ of the output $L_P$ of the main propeller and the maximum output $L_Q$ of the maneuvering propeller permitted by the FIG. 2 control circuit exceeds the available output $L_M$ of the main motor 2. This has the consequence that the main motor 2 is "pressed", namely that it is overloaded. This overload on the main motor 2 is, however, permissible under the present invention; because maneuvering systems and most other auxiliary drives on board are almost always only needed when the main motor operates in the lower part of its speed range. Furthermore, maneuvering systems in particular are used only for short periods of time. Furthermore, occurrence of an overload can be indicated by a light-message means which is switched by a speed responsive relay and which switches at a speed higher than $n_S$.

The shiftable couplings, or clutches, 3 and 21 interposed, as above described, between the main motor 2 and the main propeller 1 and adjustable hydraulic pump 17 can thus be actuated to apply energy from the main motor only to the main propeller (FIG. 4 showing main motor output $L_M$ at all speeds exceeding the requirement of main propeller output $L_p$) or only to the maneuvering propeller 11 (FIG. 4 showing main motor output at all speeds exceeding the output $L_Q$ of the maneuvering propeller) or, at low speeds of the main motor (below about 75 percent of maximum main motor speed $n_M$ in FIG. 4) simultaneously to both the main propeller and maneuvering propeller, such that at said low speeds the lever 30 is actuable to vary the amount of energy supplied by the main motor to the maneuvering propeller independent of variations in the amount of energy supplied by the main motor to the main propeller, as clear from FIG. 4.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A drive mechanism for ships or the like, comprising:

a main motor;

a main propeller or the like driven by said main motor for propelling the ship, said main motor being connected to drive said main propeller and having a speed adjustable to provide the desired main propeller speed and hence ship speed;

a maneuvering propeller or the like for lateral maneuvering of the ship;

drive means for also driving the maneuvering propeller from the main motor, the drive means comprising (a) an adjustable hydraulic pump driven by said main motor, and (b) a hydraulic motor driven by said adjustable hydraulic pump and connected for driving said maneuvering propeller;

a regulating means associated with said drive means for maintaining the maneuvering propeller at a chosen speed independent of main propeller speed, during and despite adjustments of the speed of the main motor in a part of its speed range to make desired changes in main propeller speed, said regulating means comprising (a) an adjusting mechanism for the energy emitted by said adjustable hydraulic pump or absorbed by said hydraulic motor, and (b) a regulator for adjusting said adjusting mechanism to a preselected energy output, said regulator being an actual value-desired value comparison mechanism, wherein the actual value is taken from said maneuvering propeller, and the desired value is adjustable by an advancing mechanism by means of a lever or the like, the actual value being taken from said maneuvering propeller by means of a tachogenerator;

said main motor and said maneuvering propeller being sized such that in the higher part of the speed range of said main motor, starting with a main motor speed $n_S$ which is approximately 75% of the maximum main motor speed, the sum of the output of said main propeller and the maximum output of said maneuvering propeller permitted by said regulating means exceeds the output available from said main motor;

the stroke volume of said pump being dimensioned such that with said lever at maximum deflection, in the range from the main motor idling speed $n_L$ up to a main motor speed $n_2$ of approximately 50% of the main motor maximum speed, the output of the pump is determined by its stroke volume, and above main motor speed $n_2$ the output of said pump is limited by said regulating means; and first and second clutch means interposed between said main motor and respective ones of said main propeller and said adjustable hydraulic pump, and individually actuable for alternately applying energy from said main motor (1) to said main propeller, (2) to said maneuvering propeller or (3) at low speeds of said main motor, simultaneously to said main propeller or the like and maneuvering propeller, such that at said low speeds said lever is actuable to vary the amount of energy supplied by said main motor to said maneuvering propeller independent of variations in the amount of energy supplied by said main motor to said main propeller.

2. A drive mechanism for ships or the like, comprising:

a main motor;

a main propeller or the like driven by said main motor for propelling the ship, said main motor being connected to drive said main propeller and having a speed adjustable to provide the desired main propeller speed and hence ship speed;

a maneuvering propeller or the like for lateral maneuvering of the ship;

drive means for also driving the maneuvering propeller from the main motor, the drive means comprising (a) an adjustable hydraulic pump driven by said main motor, and (b) a hydraulic motor driven by said adjustable hydraulic pump and connected for driving said maneuvering propeller;

a regulating means associated with said drive means for maintaining the maneuvering propeller at a chosen speed independent of main propeller speed, during and despite adjustments of the speed of the main motor in a part of its speed range to make desired changes in main propeller speed, said regulating means comprising (a) an adjusting mechanism for the energy emitted by said adjustable hydraulic pump or absorbed by said hydraulic motor, and (b) a regulator for adjusting said adjusting mechanism to a preselected energy output, said regulator being an actual value-desired value comparison mechanism, wherein the actual value is taken from said maneuvering propeller, and the desired value is adjustable by an advancing mechanism by means of a lever or the like, the actual value being taken from said maneuvering propeller by means of a tachogenerator;

said main motor and said maneuvering propeller being sized such that in the higher part of the speed range of said main motor, starting with a main motor speed $n_S$ which is approximately 75% of the maximum main motor speed, the sum of the output of said main propeller and the maximum output of said maneuvering propeller permitted by said regulating means exceeds the output available from said main motor;

the stroke volume of said pump being dimensioned such that with said lever at maximum deflection, in the range from the main motor idling speed $n_L$ up to a main motor speed $n_2$ of approximately 50% of the main motor maximum speed, the output of the pump is determined by its stroke volume, and above main motor speed $n_2$ the output of said pump is limited by said regulating means.

* * * * *